United States Patent [19]

Ridley et al.

[11] Patent Number: 4,485,657

[45] Date of Patent: Dec. 4, 1984

[54] TOOTH FORMING TOOL AND METHOD FOR SPLINING TUBULAR ELEMENTS

[75] Inventors: Robert R. Ridley, Pontiac; Paul Fitzpatrick, Fenton, both of Mich.

[73] Assignee: Ex-Cell-O Corporation, Troy, Mich.

[21] Appl. No.: 347,747

[22] Filed: Feb. 10, 1982

[51] Int. Cl.[3] ..... B21D 17/00; B21D 53/28; B21H 5/02

[52] U.S. Cl. ..... 72/88; 72/469

[58] Field of Search ..... 72/469, 88–90, 72/105; 76/107 R; 29/159.2

[56] References Cited

U.S. PATENT DOCUMENTS

| | | | |
|---|---|---|---|
| 3,015,243 | 1/1962 | Drader | 72/469 |
| 3,672,203 | 6/1972 | Anderson | 72/469 |
| 3,818,736 | 6/1974 | Blue | 72/469 |
| 3,827,280 | 8/1974 | Miller | 72/469 |
| 3,857,273 | 12/1974 | Miller et al. | 72/469 |
| 3,872,699 | 3/1975 | Blue | 72/469 |
| 3,874,219 | 4/1975 | Miller et al. | 72/469 |
| 3,902,349 | 9/1975 | Miller | 72/469 |
| 3,982,415 | 9/1976 | Killop | 72/88 |

FOREIGN PATENT DOCUMENTS

| | | | |
|---|---|---|---|
| 942804 | 5/1956 | Fed. Rep. of Germany | 72/88 |
| 23891 | 10/1965 | Japan | 72/88 |

*Primary Examiner*—Daniel C. Crane
*Attorney, Agent, or Firm*—Edward J. Timmer

[57] ABSTRACT

A tool is provided for pressure forming teeth in the periphery of a cylindrical, tubular workpiece such as a power transmission member by rolling. The tool has an improved tooth generating configuration which improves the flow characteristics of the metal in the workpiece and develops uniformity of tooth wall thickness during the tooth generating process.

15 Claims, 13 Drawing Figures

60
80
A
30
B
32
R
r
H
40a
4082
41
40b
R
r

H'
48
86
46
44a
44c
R'
44
44b
42
R
r

58
H''
56
88
54
52
50
R'
R'
r

TOOTH FORMING TOOL AND METHOD FOR SPLINING TUBULAR ELEMENTS

FIELD OF THE INVENTION

This invention relates to tools and machines for pressure forming tooth elements, and more particularly, to an improved tooth configuration for pressure generating teeth, splines, gear teeth forms and the like in the periphery of a tubular workpiece. A tooth forming method is also disclosed.

BACKGROUND OF THE INVENTION

The manufacture of power transmission members, to which this invention relates, utilizes a pair of racks and a mandrel to develop the tooth form in the periphery of an annular or tubular workpiece. The mandrel has the tooth form which is to be developed machined in an external peripheral working surface. A machine is provided for holding the mandrel and piece part and also includes tooth forming racks mounted on slides.

Tools for pressure forming tooth forms are shown in the patents to Pelphrey, U.S. Pat. No. 2,994,237, Miller, U.S. Pat. Nos. 3,827,280, 3,857,273, and 3,902,349, Anderson, U.S. Pat. No. 3,672,203 and Blue, U.S. Pat. No. 3,818,736. These patents show tooth forms having various characteristics for generating tooth forms in a cylindrical shaft member. The Miller U.S. Pat. No. 3,827,280 in particular discloses an initial section of sharp, file-like teeth adapted to grip and initiate rotation of a cylindrical workpiece followed by three sections of teeth adapted to generate a generally cycloidal tooth configuration which is then modified to the desired involute form by subsequent tooth sections. Another patent to Hildreth, U.S. Pat. No. 3,862,567 also shows a tool for manufacturing tooth forms which has selected teeth plated with copper, silver, gold or other suitable coating material to reduce tooth wear and fatigue. As can be seen in the aforementioned patents, the beginning or the leading portion of the tool has teeth which are deliberately altered in shape so that the rolling process will appropriately deform the metal in a gradual manner, thereby developing a final tooth shape which will be conjugate with the final tooth forms on the tool.

An early patent showing the rolling of a tooth form on a tubular element is U.S. Pat. No. 3,214,951 issued to McCardell. This shows a spline being rolled onto the outside of a tubular element. A later patent to Killop, U.S. Pat. No. 3,982,415 shows a splined mandrel and tool to specifically roll a power transmission member mounted directly on the mandrel. Here also, the teeth of the forming tool are shown having various shapes to gradually deform the metal so as to produce the desired tooth form both on the exterior of the power transmission member and on the interior thereof.

In using tools with tooth forms which have been shown in the prior art to spline tubular power transmission members, it was found that the wall thickness between the leading and trailing edge of a given tooth form on a power transmission member may vary by as much as 50% and thus is extremely nonuniform in nature. Improvement in uniformity of tooth wall thickness is highly desirable.

An object of the invention is to provide an improved tooth forming tool incorporating improved tooth generating means for improving the flow characteristics of the metal in the workpiece during the tooth generating process and developing a more uniform tooth element, especially improving uniformity in the wall thickness of the leading and trailing edges. Another object of the invention is to provide a tool for developing uniform tooth elements on both the external periphery and the internal periphery of the workpiece such as a power transmission member. Another object of the invention is to provide an improved tool for pressure forming tooth elements in a cylindrical shell which enables the quantity production of tooth elements with improved quality. An object of the present invention is to provide an improved tooth forming tool of the indicated character incorporating improved means for generating tooth elements in a cylindrical tubular member whereby the strength and useful life of such tools is increased. A further object of the invention is to provide an improved tool for pressure forming tooth elements in a cylindrical tubular member which tool is economical and commercially feasible to manufacture, and is durable, efficient and reliable in operation.

SUMMARY OF THE INVENTION

This invention provides a tool for pressure forming teeth in the periphery of a tubular workpiece. The tool is adapted to mesh with a rotatable toothed mandrel with the workpiece pressure formed therebetween. The tool includes a body having a leading end and a trailing end and is provided with a working surface having a plurality of teeth thereon wherein various sections of teeth disposed between the leading end and the trailing end have specific characteristics for pressure forming the tooth in a power transmission member during various stages of its pass through a machine adapted for such use. In a typical embodiment, the leading and trailing edges of the teeth of the first section are symmetrically configured to initially pressure form the workpiece near the center of the tooth space between adjacent mandrel teeth and thereby provide initial uniform workpiece deformation, preferably providing a uniform corrugated type workpiece profile. A second section of asymmetrical teeth is disposed between the first section and the trailing end and the teeth thereof have a leading edge configuration conjugate to the leading edge configuration of the teeth to be formed on the workpiece and a trailing edge substantially similar in configuration to that provided in the teeth of the first section. The third section of teeth disposed between the second section and trailing end of the tool have a tooth configuration fully conjugate to the configuration of the teeth to be formed in the workpiece. A fourth section of conjugate teeth with relieved flanks and root is preferably provided to iron or set the minor workpiece diameter.

According to the typical method of the invention for forming spline, gear and like teeth in a tubular workpiece with an initial annular cross-sectional profile, the workpiece is (a) pressure-formed to provide a uniform corrugated type profile, (b) pressure formed at selected, spaced locations on the workpiece profile corresponding to eventual leading edge locations into a configuration conjugate to the configuration of the leading edge of the teeth to be formed and then (c) pressure formed at remaining locations on the profile into a configuration conjugate to the trailing edge and also preferably to the tip of the teeth to be formed in the workpiece, leaving the previously formed leading edge portions substantially intact.

The above as well as other objects and advantages of the present invention will become apparent to those skilled in the art from the following descriptions of the appended claims and the accompanying drawings.

DESCRIPTION OF PREFERRED EMBODIMENTS

Figure 1:
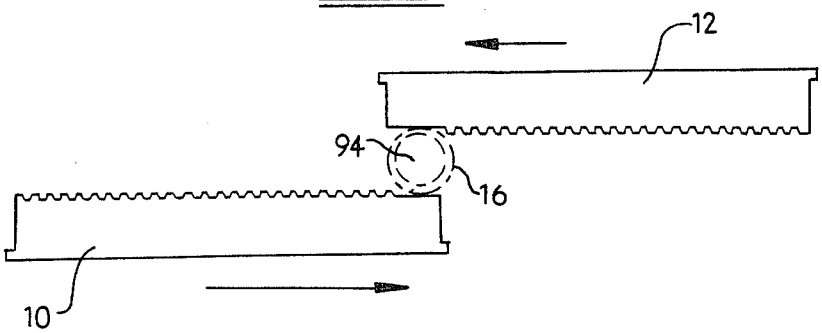
FIG. 1 is a side elevational view of a pair of rack type tools employing the present invention showing the same schematically with a mandrel and workpiece.

Referring to FIGS. 1–4, a preferred embodiment of the invention is illustrated. This embodiment comprises a specific tool construction for each of a pair of identical rack type tools 10 and 12 as shown in FIG. 1. These tools may be utilized with a splined mandrel 94 with the appropriate tooth form to pressure form spline, gear or other teeth on a cylindrical hollow workpiece. The workpiece 16 typically comprises a first large diameter tubular section 16*a* and a second smaller diameter tubular section 16*b* with a radial flange 16*c* joining the tubular sections. In the embodiment illustrated, teeth will be formed in tubular section 16*a*.

A machine in which a pair of rack type tools embodying the present invention may be utilized along with a toothed mandrel to pressure form a workpiece by deforming the cylindrical shell is described in detail in the aforementioned U.S. Pat. No. 3,214,951, the teachings of which are incorporated herein by reference, although it will be understood that tools embodying the present invention may be utilized in other types of known machines.

Figure 4:
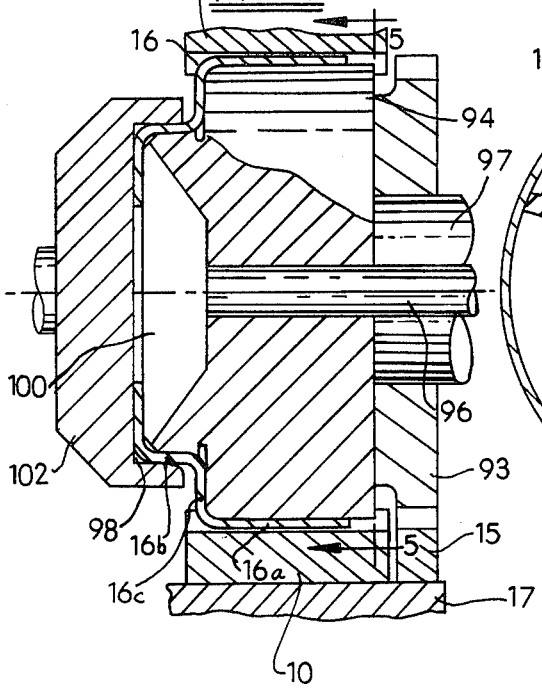
FIG. 4 is a partial sectional view showing the workpiece mounted on the stripper head and the confining member of the machine.
Figure 5:
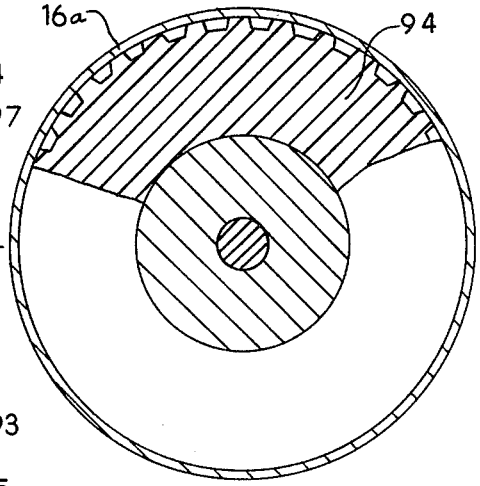
FIG. 5 is a partial sectional view along lines 5—5 of FIG. 4.

In general, as illustrated in FIG. 1, workpiece 16 is positioned between the lower and upper tools 10 and 12 embodying the present invention, the tools 10 and 12 being shown at the beginning of the operation which will pressure form the teeth on the periphery of tubular section 16*a* of the workpiece. The workpiece is rotatably supported about its longitudinal axis during splining by means such as shown in FIG. 4 known to those in the art. Here, the workpiece is shown supported on stripper head 100. A confining member 102 is also shown holding the workpiece 16 onto the stripper head 100. The details of this holding means can be found in the aforementioned U.S. Pat. No. 3,214,951 and need not be discussed in detail here. The stripper head 100 which is connected to stripper rod assembly 96 is similar to that which is found in U.S. Pat. No. 4,178,790 issued to Buckley, et al. which shows another method of manufacturing tooth elements in a cylindrical shell. The stripper head 100 is shown in detail in the aforementioned patent and will not be discussed here.

The lower and upper tools 10 and 12 are illustrated as identical rack type tools with teeth on their opposing working faces that engage the periphery of the tubular section 16*a* of the workpiece. The tools are movable lengthwise by suitable known means and are illustrated as being slideable in the direction of the arrows shown in FIG. 1. Means are provided to simultaneously move the tools 10 and 12 in opposite directions and such means are well known and shown in the aforementioned machine patents. Means in the form of a timing gear 93 carried on shaft 97 and a timing rack 15 carried on slide 17 with the tool 10 are provided to time or synchronize movement of the tools 10 and 12 and mandrel 94 to insure proper meshing of teeth.

Figure 2:
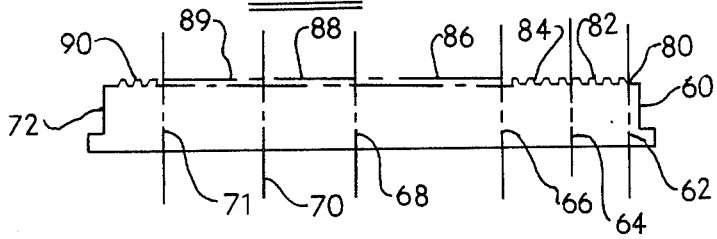
FIG. 2 is a side elevational view of the entire bottom rack type tool illustrated in FIG. 1.
Figures 3A, 3B, 3C:
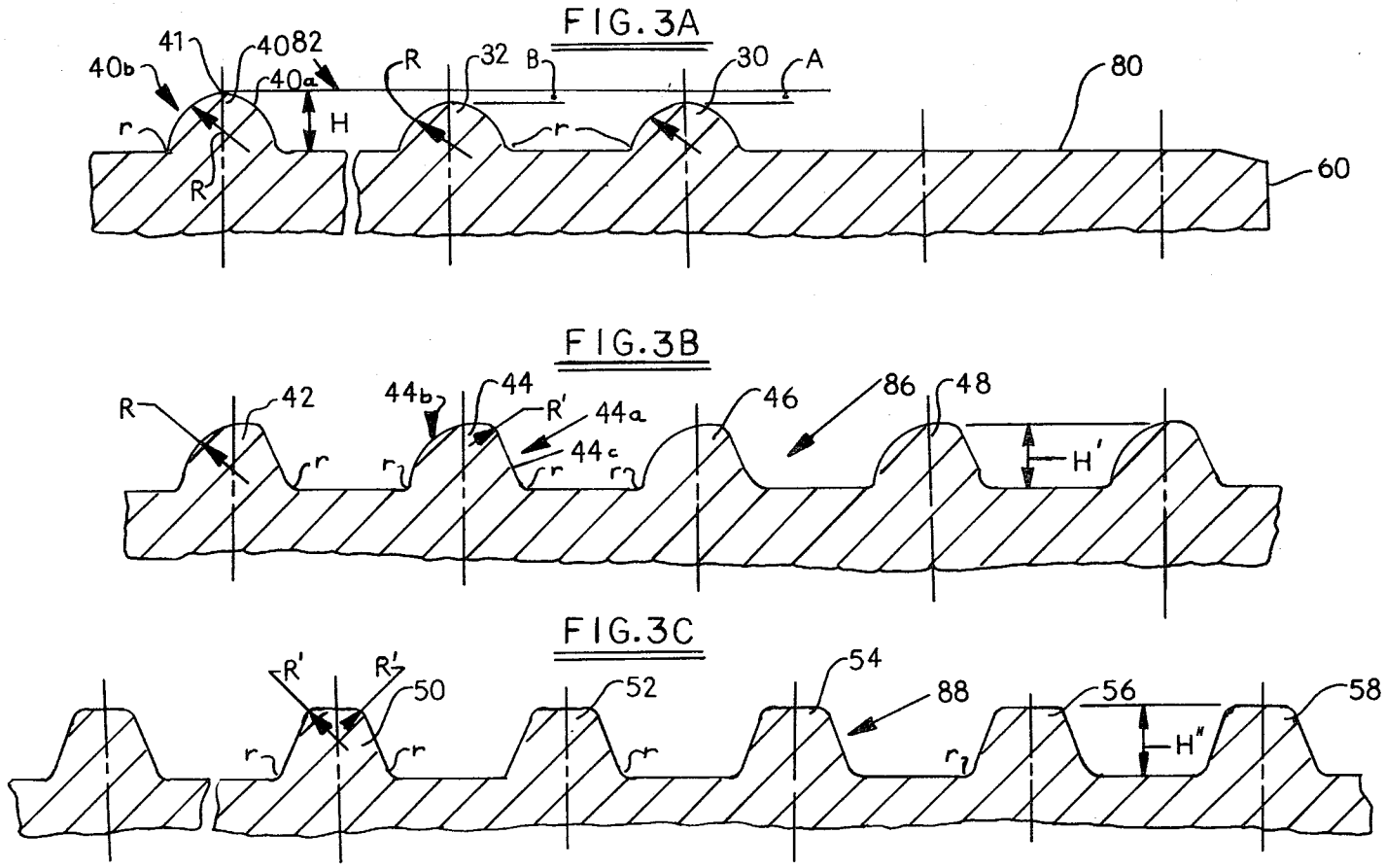
FIG. 3A is a partial section of the tool shown in FIG. 2.
FIG. 3B is a partial section of the tool shown in FIG. 2.
FIG. 3C is a partial section of the tool shown in FIG. 2.

FIG. 2 in conjunction with FIGS. 3A–C shows the various sections of each tool and the relationship of the teeth shown in FIG. 3 to their position along the length of the tool. The tool shown in FIG. 2 has a leading end 60 with surface 80 which is approximately two teeth in length and is preferably flat and devoid of any tooth form. This surface 80 functions to clamp the workpiece against the mandrel and minimize the wave efect generated in the workpiece during the first 180° of rotation thereof by initial contact with the tools. Tooth forming tools having this initial flat, toothless clamping section on the working surfaces are described and claimed in a copending application entitled "Tooth Forming Tool With Initial Toothless Clamping Section For Tubular Elements" filed in the name of Nicholas J. Carene and of common assignee herewith, the teachings of which are incorporated herein by reference.

The toothed section 82 of FIG. 2 which begins at line 62 and extends to line 64 consists of six teeth which have a symmetrical tooth form (relative to the vertical centerline) shown in FIG. 3A. The tooth profile form of tooth 40 is a gothic or a equilateral pointed arch shape provided in part by leading and trailing edges 40*a* and 40*b*. The half pointed arch form between tip 41 and root r of both the leading and trailing edges 40*a* and 40*b* of the tooth is shown at height H which is approximately 85%, typically between 80% and 90%, of the full conjugate tooth height which is to be developed in the workpiece. The radius R shown in FIG. 3A is approximately 130 thousandths or 0.130 inches on both the leading and trailing edges of these first six teeth. As can be seen on teeth 40, 32 and 30, the height of the teeth decreases from tooth 40 to tooth 30 with tooth 30 having lowest height at dimension A below tooth 32 and tooth 40 having the full height H. Dimension A and B differ by approximately 0.002 inch. That is, dimension A itself is 12 thousandths, dimension B is 10 thousandths continuing on back along the other teeth in this section until the tooth preceding tooth 40 will have a 2 thousandths difference in height therewith. The purpose of this lead-in section is to gradually start to deform the thin shell of tubular workpiece section 16*a* in a uniform manner substantially near the center of the tooth space between adjacent mandrel teeth as will be described in more detail later. The lead-in section is also useful to release the splined workpiece in the event it is desirable to have the workpiece exit off that end 60 of the tool. As noted, the teeth of this section of the tool preferably will have the gothic or equilateral pointed arch form terminating in a reasonably sharp peak at 41 for example. However, other radii or a slightly flattened surface could also be employed at the very peak of the tooth form. However, best results were obtained with the pointed arch having the indicated radii. The next section 84 of teeth shown in FIG. 2 comprises approximately 18 teeth and all have the height H and equilateral pointed arch form of tooth 40 shown in FIG. 3A. These teeth extend from line 64 to line 66 and together with the symmetrical teeth previously described between lines 62 and 64 constitute a first section of symmetrical teeth.

The second section 86 of the tool has teeth extending from line 66 to line 68. The 18 teeth in this section of the tool have the asymmetrical configuration shown in FIG. 3B. Here, the height of the tooth form H′ will be approximately 96% of the full conjugate tooth height. The teeth can be seen to have a large radius R on the trailing edge 44*b* of the tooth form which is substantially the same radius as that in the previous section, that is, a 0.130 inch radius like tooth 40 shown in FIG. 3A. The leading edge 44*a* of the tooth, however, as noted for tooth 44, will have a small radius portion R′ which will be only approximately 55 thousandths and conjugate to the leading edge of the tooth to be formed in the workpiece and will be discussed in more detail later. Preferably, the leading flank portion 44*c* of the teeth in the second section will also be conjugate to the leading flank of the tooth to be formed. The radius r at the root of the tooth will be consistent throughout the tool. Also shown here are additional tooth forms 46 and 48 having an identical configuration as that of tooth 42. The teeth of section 86, as noted earlier, total approximately 18 in number and extend from line 66 to line 68.

The third section 88 of the tool contains teeth shown in FIG. 3C. The teeth of section 88 will all have the symmetrical shape of the teeth 50 through 58 which is the full conjugate tooth form of the tooth form to be formed having radii R′ of about 55 thousandths at both the leading and the trailing edge of the tooth form and having a radius of r at the root of the tooth form. The height of the tooth form H″ here will be considered 100% in viewing the relationship of these teeth to the other teeth on the tool. The teeth 50–58 will extend between line 68 and line 70 with approximately 24 teeth having this full configuration.

A fourth section 89 of teeth is preferably provided from line 70 to line 71 and includes about twenty-four teeth having the symmetrical conjugate tooth form of teeth 50–58 (FIG. 3C), except that the tooth flanks and root in section 89 are relieved compared to those of teeth 50–58 by for example 0.003 inch. That is, the tooth height in section 103 is 3 thousandths greater than tooth height H″ in section 88 and the tooth addendum is likewise greater by 3 thousandths. The tooth height in section 89 would be considered 102%. The leading and trailing edge radii of the teeth in section 89 are the same as those of teeth 50–58, namely about 55 thousandths. The purpose of the teeth in section 89 is to iron or set the metal shell at the minor (inner) diameter after splining by the previous tooth sections.

A final section 90 of the tool which will extend from line 71 to the trailing end 72 of the tool will have approximately 6 teeth in number. These teeth will have the same configuration as shown in FIG. 3C except beginning at the sixth tooth from the end 72, a top taper (0.002 inch relief) will occur so that the last tooth in section 90 will be 10 thousandths lower than height H″. In other words, the last tooth will have a height approximately 93% of the full height of the teeth 50–58.

It is apparent that, except for sections 82 and 90, the root line within each section of teeth is preferably constant although the root line from one section of teeth to another may vary. The linear pitch for all of the teeth of the tools 10 and 12 will be the same and will be selected to produce the desired tooth form on the external section of the workpiece section 16*a*. The tooth form and circular pitch provided on the mandrel 94 depends on the inner section or inner tooth form desired and is correlated with the tooth form provided on the tools 10 and 12 as is well known in the art.

Operation of the Preferred Embodiment

Figure 6:
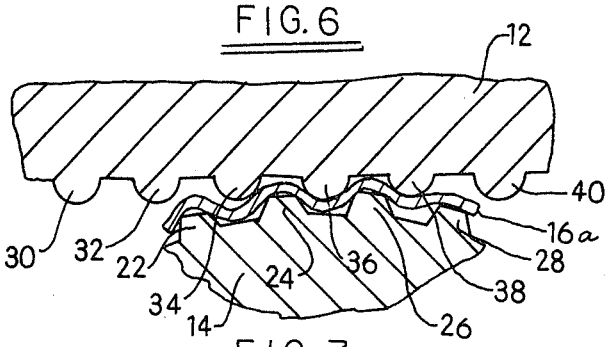
FIG. 6 is a partial section of the first toothed section of the tool and mandrel showing the workpiece therebetween.
Figure 7:
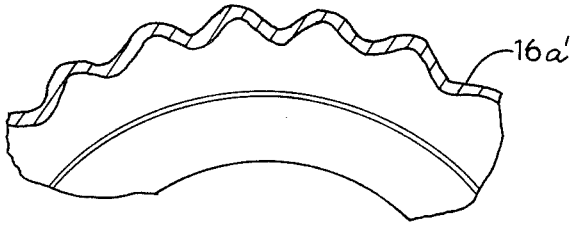
FIG. 7 is a partial section of the workpiece having a uniform corrugated or cycloidal type profile after passing through the first toothed section of the tool.
Figure 8:
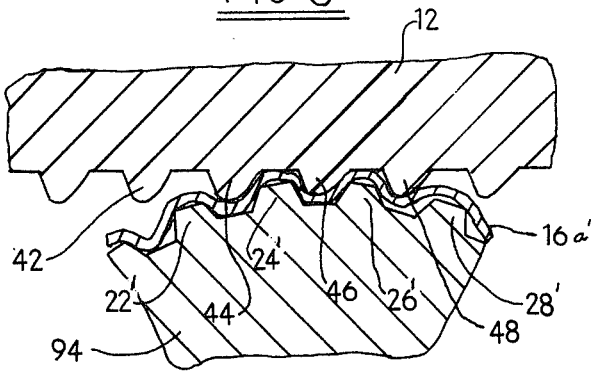
FIG. 8 is a partial section of the second toothed section of the tool and mandrel showing the workpiece therebetween.
Figure 9:
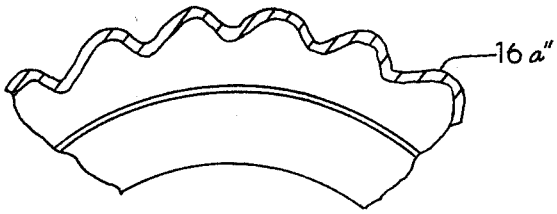
FIG. 9 is a partial section of the workpiece showing the teeth formed after a pass through the section of the tool shown in FIG. 8.
Figure 10:
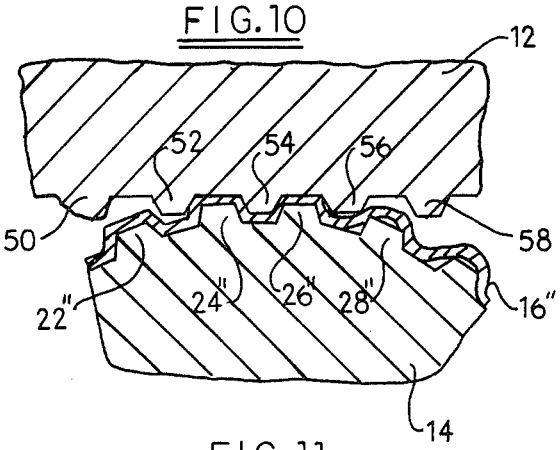
FIG. 10 is a partial section view of the third toothed section of the tool and mandrel showing the workpiece therebetween.
Figure 11:
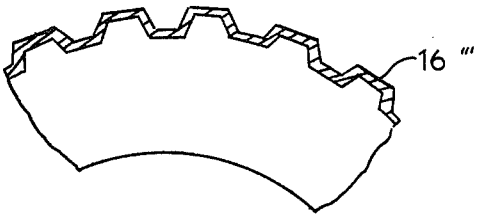
FIG. 11 is a partial sectional view of the piece part after completion of the rolling operation.

With the prior art tooth forms similar to that shown in FIG. 3C, the small leading edge radius R′ would be the first edge to strike the periphery of the workpiece 16. The leading edge would strike the workpiece off-center relative to the adjacent mandrel tooth space and would cause a pinching or trapping effect, drawing the metal unevenly into the mandrel tooth form and, upon completion of the rolling operation, providing a non-uniform tooth form. In particular, the leading edge of the final tooth form would be thicker than the trailing edge of that tooth form. In order to compensate for the off-center initial pressure contact and uneven deforming or flowing of the metal that occurred, the tooth form shown in FIG. 3A was used, that is, having the gothic tooth form or equilateral pointed arch form, spaced at the correct distance corresponding to the circular pitch of the tooth form. The movement of the tool into the workpiece as shown in FIG. 6 would then cause the material to be deformed in a uniform manner on both the leading and the trailing edge substantially centrally in the tooth space 25 between the adjacent mandrel teeth 24 and 26, for example. As seen in FIG. 6, the tooth 36 on the tool 12 has deformed the workpiece portion 16*a* in a uniform manner substantially near the center between the mandrel teeth 24 and 26 and since the height of the tooth is only 85% of the full conjugate height, the stretching or flowing of the peripheral surface of the shell will be uniform and will not cause a stretching of the trailing edge of the tooth form and a thickening of the leading edge of that tooth form. As can be seen in FIG. 7, workpiece 16*a*′ exhibits a uniform corrugated or cycloidal type cross-sectional profile and a uniform precursory tooth form. FIG. 8 shows the tool 12 and the mandrel 94 with the workpiece 16*a*′ therebetween. The teeth 42 through 48 have the asymmetrical configuration of the tooth form shown in FIG. 3B. The mandrel 94 may have the conjugate full depth tooth form shown with teeth 22′, 24′, 26′ and 28′. The leading edge of tooth 46 of the tool can be seen to have the full conjugate small radius leading edge tooth form and causes the workpiece to flow at selected locations on the corrugated profile corresponding to leading edge locations into the leading edge of the tooth form on the mandrel. This effect causes the uniformity of the wall section or tooth section that is desired. The height of the tooth, as shown in FIG. 3B, is H' which is approximately 96% of the full conjugate tooth height. This flowing of the workpiece into the shape shown in FIG. 9 of workpiece 16*a*'' will set that leading edge portion of the tooth form so that no additional substantial stretching or flowing will occur at that portion in the next stage of the operation. Working of the remaining portion of the workpiece profile is shown in FIG. 10 as can be seen by the teeth 50 through 58 engaging the mandrel teeth 22'' through 28'' with the workpiece 16'' therebetween. Here, it can be seen that the tooth form of the teeth 50 through 58 are the full depth for those shown as teeth 88 in FIG. 2. This full conjugate tooth form, better seen in FIG. 3C, will develop what will now be the trailing edge and top land or tip of the tooth on the remaining workpiece profile, and as can be seen, the tooth form of the workpiece 16*a*'' laying on tooth 28'' is coming into contact with the tool 12. Since the leading edge of the tooth has been formed in the previous section 86 of the tool, the leading edge of that tooth form will retain the same shape. The trailing edge of the tool tooth form will cause the workpiece material now to flow and develop the full conjugate shape 16*a*''' including trailing edge and top land or tip which is shown in FIG. 11. The fourth section 89 will iron or set the minor workpiece diameter.

In summary, the first section of the tool having the symmetrical tooth form shown in FIG. 3A will develop a corrugated workpiece profile. The first section will cause the periphery of the workpiece to be uniformly stretched and shaped with the original or first contact being near the center or midpoint of each tooth form space between the mandrel teeth. This will cause a uniform substantially central deformation or flowing of the workpiece as it contacts the tooth in the mandrel. The second section of the tool having the asymmetrical tooth form shown in FIG. 3B will effect deformation of the leading edge of the tooth form and, because the workpiece has been previously stretched into the corrugated shape, it will not stretch a great deal more but will conform to the proper leading edge shape on the tooth form of the mandrel. The trailing edge of the tooth form will conform to the previous shape formed by the first section. Although there is a slight increase in the tooth height at this point, it will not cause a thinning out of the trailing edge. The conjugate tooth form of the tool shown in FIG. 3C will then develop the trailing edge and top land or tip of the tooth form in the workpiece and will give the proper and full conjugate shape to the tooth form. It was found that by using this tool in lieu of prior art type tools, the improvement in the uniformity of the leading and trailing wall thicknesses on the workpiece was achieved with thicknesses being uniform within 2 to 3%. In contrast, prior to the use of this tool, the thicknesses between the leading and trailing edge of the tooth form varied by 75 to 100%. That is, an original cylindrical shell having a thickness of approximately 80 thousandths would produce a workpiece or a power transmission member which had a leading edge tooth thickness of 70 thousandths versus a trailing edge tooth thickness of approximately 40 thousandths. When the tool shown in the instant invention was used, the leading and trailing tooth forms varied between 42 and 46 thousandths and had the correct conjugate tooth form on both the interior surface and on the exterior surface of the work-piece.

At the completion of the rolling operation, the stripper rod assembly 96 and stripper head 100 shown in FIG. 4 are used to remove the formed work-piece 16. As mentioned earlier, this method of stripping the part is shown in U.S. Pat. No. 4,178,790. Also shown in FIG. 4 is a confining member 102 which secures the workpiece to the stripper head by way of a pilot diameter 98 and holds the workpiece in position for its pass through the machine. This method of holding the workpiece is shown in U.S. Pat. No. 3,214,951.

What has thus been described is a tool for use in the forming of a power transmission member having a spline or gear tooth form. Also described is a tool for pressure forming teeth in the periphery of a tubular workpiece and adapted to mesh with a rotatable toothed mandrel with the workpiece pressure formed therebetween. The tool includes a body having a leading end and a trailing end and is provided with a working face having a plurality of teeth thereon. A first section of symmetrical teeth is disposed between said leading end and the trailing end, each of the teeth in the first section being symmetrical and having leading and trailing edges configured to uniformly deform the workpiece. A second section of teeth is disposed between the first section and the trailing end of the tool. Each of the teeth in this second section is asymmetrical, having the leading edge configuration conjugate to the leading edge configuration of the teeth to be formed so that the workpiece located therebetween will develop the leading edge of the tooth form and a trailing edge configuration similar to the trailing edge configuration of the first described toothed section. A third section of the teeth on the tool is disposed between the second section and trailing end. Each of the teeth in this third section have the teeth configuration conjugate to the configuration of the teeth to be formed on the workpiece. A fourth section of teeth is preferably provided having the conjugate tooth form except that the tooth flanks and root are relieved so as to iron or set the minor workpiece diameter after passing through the third section. The last section of the tool will have the teeth gradually decreasing in height to release the workpiece as it completes the operation on the tools. Although the tooth form shown in the preferred embodiment is a transverse tooth form, it is conceivable that helical type tooth forms could be produced on such an arrangement using the same principles that are disclosed herein. It will be understood that if the tools are to generate helical teeth on the workpiece, the tool teeth will be inclined to the sides of the tool or directions of tool movement.

While preferred embodiments of the invention have been illustrated and described, it will be understood that various changes and modifications may be made without departing from the spirit and scope of the invention.

We claim:

1. In the combination of a rotatable mandrel having spaced apart external teeth and tool means having spaced apart teeth in meshing engagement with the mandrel teeth with a tubular workpiece therebetween to pressure form a selected spline, gear or like tooth form in the periphery of the workpiece, said tool means including a body having a leading end and a trailing end and being provided with a working face having a plurality of teeth thereon, a first section of said teeth being disposed between said leading end and trailing end, each of said teeth in said first section having a leading edge and trailing edge configuration configured to initially deform the workpiece substantially centrally in the space between adjacent mandrel teeth, a second section of said teeth being disposed between said first section and said trailing end, a third section of said teeth being disposed between said second section and said trailing end, each of said teeth in said third section having a leading edge and trailing edge configuration providing a tooth form conjugate to said selected tooth form, each of said teeth in said second section being asymmetrically configured with a leading edge corresponding substantially in configuration to that of said teeth in said third section and a trailing edge corresponding substantially in configuration to that of said teeth in said first section.

2. The combination of claim 13 wherein said tool means further includes a fourth section of teeth between said third section and trailing end, each of the teeth in said fourth section having a tooth configuration conjugate to the configuration of the teeth of said third section except that the tooth flanks and root are relieved so that said fourth section functions to iron the minor workpiece diameter.

3. The combination of claim 13 wherein the teeth in said first section of said tool means are symmetrically configured.

4. The combination of claim 3 wherein the teeth in said first section of said tool means are gothic arch in configuration.

5. The combination of claim 1 wherein the height of the teeth in said first section and second section is smaller than the height of the teeth in said third section and the height of the teeth in said first section is smaller than the height of the teeth in said second section.

6. A tool for pressure forming a selected spline, gear or like tooth form in the periphery of a tubular workpiece, said tool including a body having a leading end and a trailing end and being provided with a working face having a plurality of teeth thereon, a first section of said teeth being disposed between said leading end and trailing end, each of said teeth in said first section having a leading edge and trailing edge configuration configured to provide a symmetrical pointed arch tooth form, a second section of said teeth being disposed between said first section and said trailing end, a third section of said teeth being disposed between said second section and said trailing end, each of said teeth in said third section having a leading edge and a trailing edge configuration providing a tooth form conjugate to said selected tooth form, each of said teeth in said second section being asymmetrically configured with a leading edge corresponding substantially in configuration to that of the teeth in said third section and a trailing edge corresponding substantially in configuration to that of said teeth in said first section.

7. The tool of claim 6 further including a fourth section of teeth between said third section and trailing end, each of the teeth in said fourth section having a tooth configuration conjugate to the configuration of the teeth of said third section except that the tooth flanks and root are relieved so that said fourth section functions to iron the inner workpiece diameter.

8. The tool as set forth in claim 6 having the first section wherein at least six teeth are progressively shorter toward the leading end of the tool.

9. The tool as set forth in claim 6 wherein the first section of the teeth have a height of from 80 to 90% of the height of the teeth of said third section.

10. The tool of claim 7 wherein the fourth section has at least six teeth relieved to gradually decrease in height toward the trailing end.

11. The tool as set forth in claim 6 wherein the height of the teeth in the first and second section is smaller than the height of the teeth in said third section and the height of the teeth in the first section is smaller than the height of the teeth of the second section.

12. A tool for pressure forming a spline, gear or like tooth form with each tooth form having a leading edge and trailing edge having radius portions with a selected radius in the periphery of a tubular workpiece, said tool including a body having a leading end and a trailing end and being provided with a working face having a plurality of teeth thereon, a first section, second section and third section of teeth on the working face extending in succession between the leading end and trailing end, said third section having teeth with each tooth having a leading edge and trailing edge each including a radius portion with said selected radius, said first section having teeth with each tooth having a leading edge and trailing edge each including a radius portion with a radius substantially larger than said selected radius, said second section having asymmetrical teeth with each tooth having a leading edge including a radius portion with a radius substantially similar to the radius of the teeth in said third section and a trailing edge including a radius portion with a radius substantially similar to the radius of the teeth in said first section.

13. A method for forming selected spline, gear and similar teeth with a leading edge and trailing edge configuration in a tubular workpiece having an initial annular cross-sectional workpiece profile, comprising the steps of:

(a) pressure forming the tubular workpiece with symmetrically-shaped tooth forms meshing with mandrel teeth with the workpiece therebetween to initially form preliminary leading and trailing edges with substantially uniform wall thickness on the workpiece profile, (b) pressure forming the workpiece of step (a) with asymmetrical tooth forms meshing with mandrel teeth with the workpiece therebetween at selected, spaced locations on the workpiece profile corresponding to eventual leading edge locations to impart the leading edge configuration to said locations with a selected leading edge wall thickness, and then (c) pressure forming the workpiece with tooth forms conjugate to said selected teeth meshing with mandrel teeth with the workpiece therebetween at remaining locations on the workpiece profile corresponding to eventual trailing edge locations to impart the trailing edge configuration to said remaining locations and a trailing edge wall thickness similar to that of the leading edges, leaving the thickness of the leading edges formed in step (b) substantially intact.

14. The method of claim 13 wherein the step (c) pressure forming step also forms the remaining locations of the workpiece profile to impart a tooth tip configuration thereto corresponding substantially to that of said conjugate tooth forms.

15. The method of claim 13 wherein steps (a), (b) and (c) are carried out with first and second sliding toothed racks having said symmetrically shaped tooth forms, asymmetrical tooth forms and conjugate tooth forms arranged in succession therealong and engaging the tubular workpiece at diametrically opposite sides on a mandrel with the rack tooth forms configured to produce the respective leading edge and trailing edge configuration of each step by meshing with the teeth of the mandrel disposed inside the workpiece.

* * * * *